US008262049B2

(12) United States Patent
Evanoff

(10) Patent No.: US 8,262,049 B2
(45) Date of Patent: Sep. 11, 2012

(54) PORTABLE STAND

(76) Inventor: Robert J Evanoff, Stillwater, MN (US)

( * ) Notice: Subject to any disclaimer, the term of this patent is extended or adjusted under 35 U.S.C. 154(b) by 184 days.

(21) Appl. No.: 12/641,082

(22) Filed: Dec. 17, 2009

(65) Prior Publication Data

US 2010/0155564 A1 Jun. 24, 2010

Related U.S. Application Data

(60) Provisional application No. 61/138,668, filed on Dec. 18, 2008.

(51) Int. Cl.
*A47B 97/04* (2006.01)

(52) U.S. Cl. ..... 248/448; 248/457; 248/461; 211/135

(58) Field of Classification Search ..... 248/441.1, 248/447, 448, 457, 461; 211/45, 135
See application file for complete search history.

(56) References Cited

U.S. PATENT DOCUMENTS

| | | | | | |
|---|---|---|---|---|---|
| 575,729 | A * | 1/1897 | Palmer | 248/448 |
| 1,612,192 | A * | 12/1926 | Johnson | 226/187 |
| 1,818,717 | A * | 8/1931 | Kliegl | 248/448 |
| 2,046,134 | A * | 6/1936 | Ryang | 248/461 |
| 4,312,490 | A * | 1/1982 | Biasini | 248/542 |
| 4,372,518 | A * | 2/1983 | Biasini | 248/441.1 |
| 4,894,756 | A * | 1/1990 | Jan | 362/97.4 |
| 5,037,057 | A * | 8/1991 | Andrews | 248/460 |
| 5,356,109 | A * | 10/1994 | Biasini | 248/448 |
| 5,441,228 | A * | 8/1995 | Geborek | 248/441.1 |
| 5,636,824 | A | 6/1997 | Biasini et al. | |
| 6,017,011 | A * | 1/2000 | Lee | 248/441.1 |
| 6,202,973 | B1 * | 3/2001 | Navarin et al. | 248/444 |
| 6,264,161 | B1 | 7/2001 | Waggoner | |
| 6,293,511 | B1 * | 9/2001 | Shepherd | 248/441.1 |
| 6,802,485 | B1 * | 10/2004 | Cassidy | 248/441.1 |
| 6,808,153 | B1 | 10/2004 | Kelley | |
| 6,889,950 | B2 | 5/2005 | Evanoff | |
| 7,258,320 | B2 | 8/2007 | Tai | |
| 7,455,275 | B1 * | 11/2008 | Astadan et al. | 248/441.1 |
| 2002/0066837 | A1 | 6/2002 | Dunbar | |
| 2003/0168569 | A1 * | 9/2003 | Simson et al. | 248/441.1 |

* cited by examiner

*Primary Examiner* — Bradley Duckworth
(74) *Attorney, Agent, or Firm* — Dicke, Billig & Czaja, PLLC

(57) ABSTRACT

A portable stand includes a shelf having a back plate with a front surface and a rear surface, wherein the back plate includes at least two attachment locations and at least one securing locations, a bottom flange forming an angle with the back plate, extending toward the front surface at a first angle from the plate, and a mounting element. The portable stand includes a shelf extension including two elongated flanges formed at an angle equal to the first angle configured to selectively couple to the shelf, and an arm pivotably attachable to the shelf extension.

20 Claims, 6 Drawing Sheets

PORTABLE STAND

CROSS-REFERENCE TO RELATED APPLICATIONS

This application claims priority under 35 U.S.C. §119(e) to U.S. Provisional Patent Application Ser. No. 61/138,668, filed on Dec. 18, 2008, and incorporated herein by reference.

BACKGROUND

This invention relates to a portable stand, in particular to a portable music stand that allows for greater flexibility in use and portability.

SUMMARY

One aspect provides a portable stand. The portable stand includes a shelf having a back plate with a front surface and a rear surface, wherein the back plate includes at least two attachment locations and at least one securing locations, a bottom flange forming an angle with the back plate, extending toward the front surface at a first angle from the plate, and a mounting element. The portable stand includes a shelf extension including two elongated flanges formed at an angle equal to the first angle configured to selectively couple to the shelf, and an arm pivotably attachable to the shelf extension.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

A portable stand is provided that is configured to have improved ease of transport and use. Embodiments described below provide a portable stand that is configured to be disassembled from an erected assembly and reassembled into a compact carrying assembly. The portable stand is desirably lightweight and compact for ease of transporting. The portable stand is desirably adjustable and provides a sturdy platform when erected. The portable stand provides ease of assembly and disassembly as well as ease of adjustability in positioning when assembled.

Figure 1:
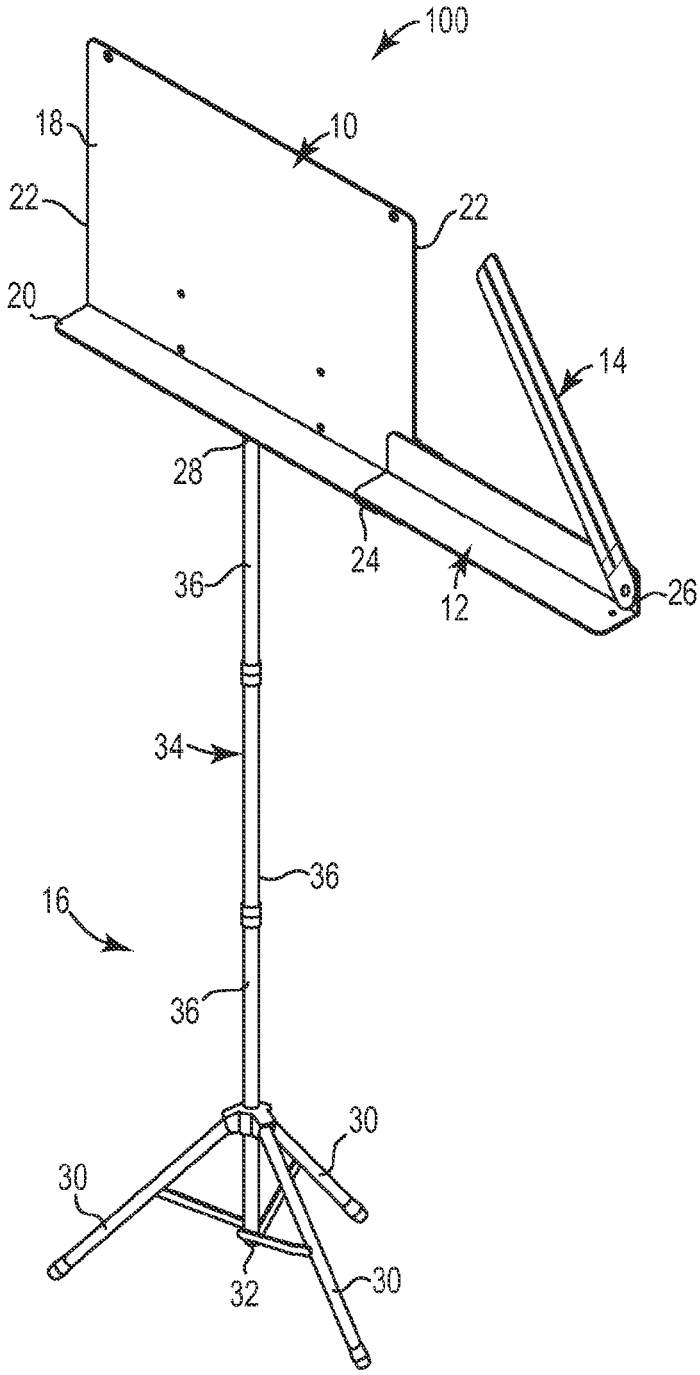
FIG. 1 illustrates a perspective view of a portable stand as an erected assembly according to one embodiment.

FIG. 1 illustrates a portable stand 100 as an erected assembly, according to one embodiment. In one embodiment, portable stand 100 includes shelf 10, shelf extension 12, arm 14, and tripod 16. In one embodiment, shelf extension 12 couples with back plate 18 and flange 20 of shelf 10. In one embodiment, shelf extension 12 is coupled to either side 22 of shelf 10 with brackets 24. In one embodiment, arm 14 is connected to shelf extension 12 at connection point 26. Arm 14 is pivotable to any desired angle with respect to shelf extension 12 at connection point 26. In one embodiment, for example, arm 14 is oriented parallel to the side 22 of shelf 10. In another embodiment, arm 14 is angled toward shelf 10. In one embodiment, an extension 12 may be coupled to each side 22 of shelf 10. When assembled to shelf 10, shelf extension 12 and arm 14 enable portable stand 100 to accommodate full size sheet music. In one embodiment, shelf 10, shelf extension 12, arm 14, and tripod 16 are made of a rigid material such as rigid plastic, metal, a combination of plastic and metal, or any other suitable material. In one embodiment, shelf 10, shelf extension 14 and arm 16 are a powder-coated metal.

In one embodiment, portable stand 100 provides a stable platform for displaying sheet music or other material. Portable stand 100 may be erected with or without shelf extension 12 and arm 14. Shelf 10 is adjustable such that back plate 12 is oriented horizontally, vertically or at some other angle. In another embodiment, portable stand 100 may be used as a portable workstation for a laptop or other devices by pivoting shelf 10 with respect to tripod 16, thereby providing a relatively horizontal workstation. Further, shelf 10 is rotatable on a vertical axis with respect to tripod 16. In one embodiment, tripod 16 engages with shelf 10 at a first end 28. Support legs 30 at the opposing second end 32 are extendable outward from vertical post 34. In one embodiment, tripod 16 includes three support legs 30, however four support legs, for example, are also acceptable. In one embodiment, the height of vertical post 34 is adjustable through extension and retraction of sections 36. In one embodiment, sections 36 are adjustable with one hand of a user while portable stand 100 is erected.

Figure 2:
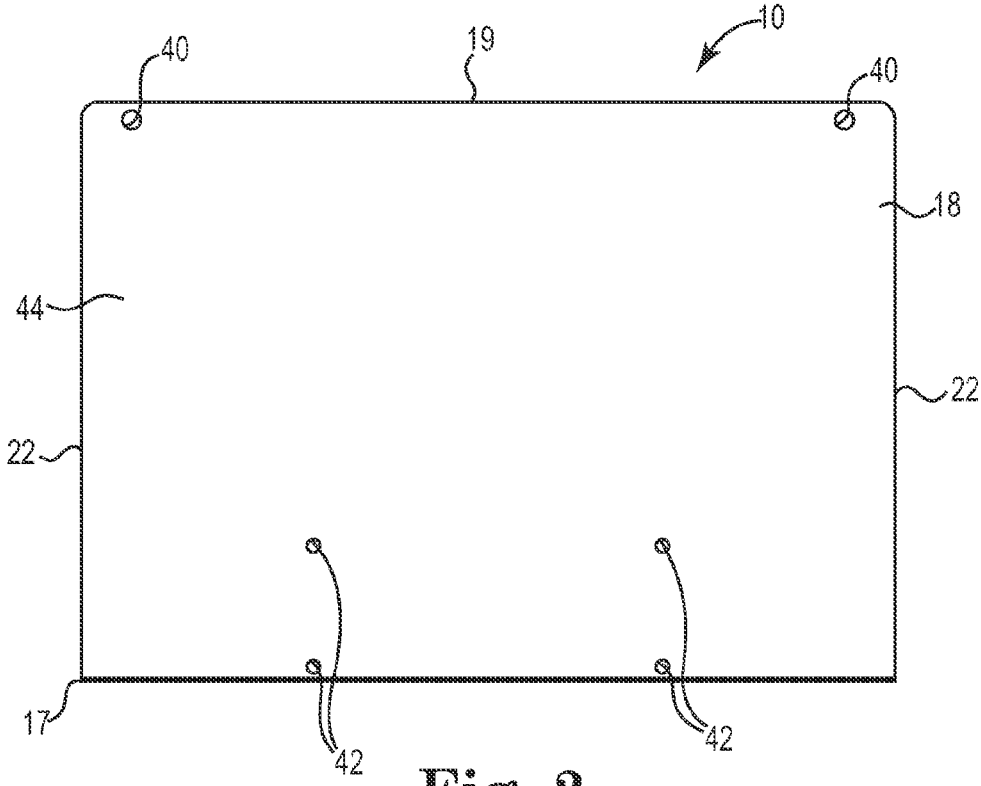
FIG. 2 illustrates a front view of a shelf according to one embodiment.
Figure 3:
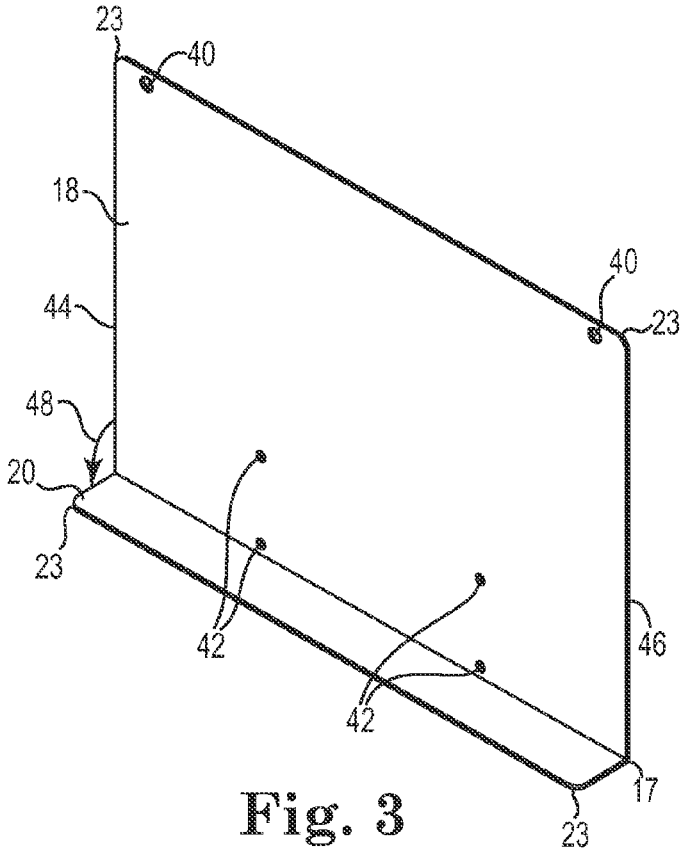
FIG. 3 illustrates a perspective view of the shelf according to one embodiment.
Figure 4:
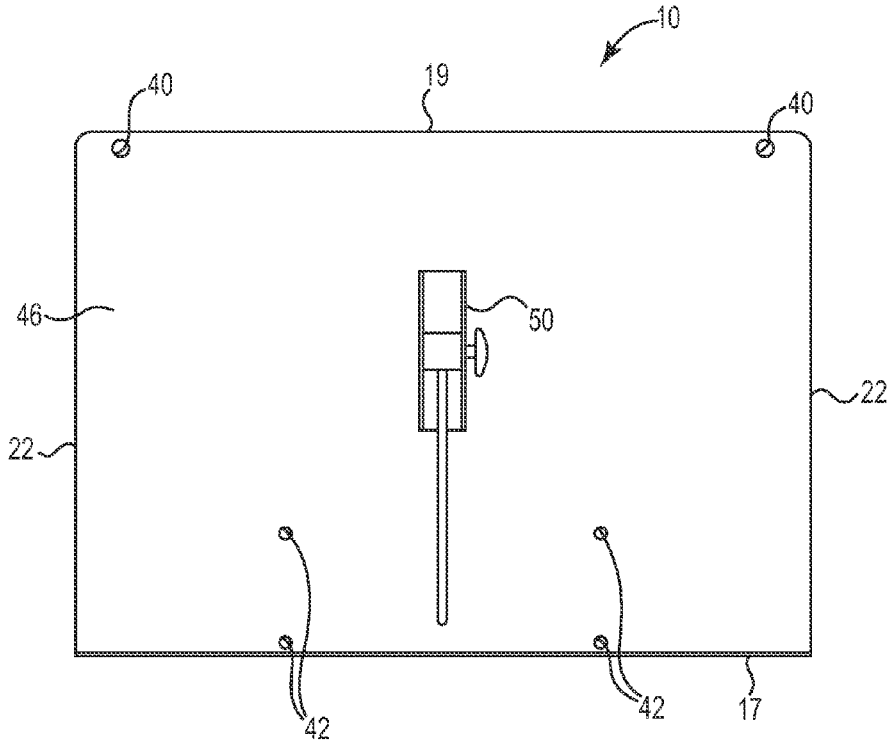
FIG. 4 illustrates a back view of the shelf according to one embodiment.

FIGS. 2-4 illustrate shelf 10 of portable stand 100. As seen in the front view of shelf 10 provided in FIG. 2, shelf 10 includes back plate 18 and flange 20. In one embodiment, back plate 18 is rectangularly shaped and includes top edge 19, bottom edge 17, and two side edges 22. In one embodiment, the exposed outer corner edges 23 of shelf 10 are rounded. As seen in the perspective of shelf 10 illustrated in FIG. 3, bottom plate or flange 20 is connected to back plate 18 at bottom edge 17. In one embodiment, shelf 10 is an L-shaped configuration wherein bottom plate 20 extends from front surface 44 of back plate 18 at a first angle 48. In one embodiment, first angle 48 is approximately 90 degrees.

In one embodiment, holes 40 and 42 are provided through back plate 18, extending from front face 44 to back face 46. In one embodiment, two attachment holes 40 are located near top edge 19. In another embodiment, attachment holes 40 are located along side edges 22, between top edge 19 and bottom edge 17. In one embodiment, holes 40 provide for attaching a carrying strap, shoulder strap, or other transporting mechanism (illustrated in FIG. 11). In one embodiment, securing holes 42 are provided near bottom edge 17 of back plate 18. In one embodiment, securing holes 42 are used for securing other elements of portable stand 100, discussed below, to shelf 10 during transport or storage.

As illustrated in FIG. 4, a mounting element 50 is provided on back surface 46. In one embodiment, mounting element 50 is suitable for mating with first end 28 of tripod 16. In one embodiment, mounting element 50 includes nuts, bolts, pivot legs, brackets or other means to facilitate assembly with tripod 16 when the portable stand 100 is assembled for use. Mounting element 50 provides a pivotable connection to tripod 16. Mounting element 50 is configured to be suitable for attachment to the vertical post of any standard tripod. Any standard mounting configuration is acceptable.

Figure 5A:
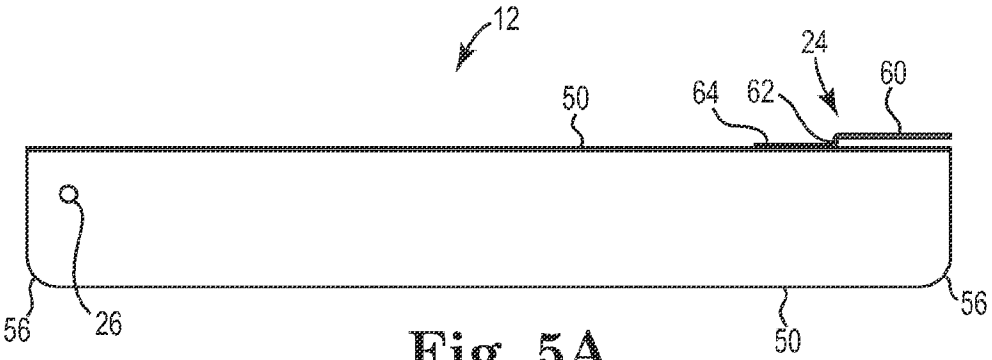
FIGS. 5A and 5B illustrate side views of a shelf extension according to one embodiment.
Figure 5B:
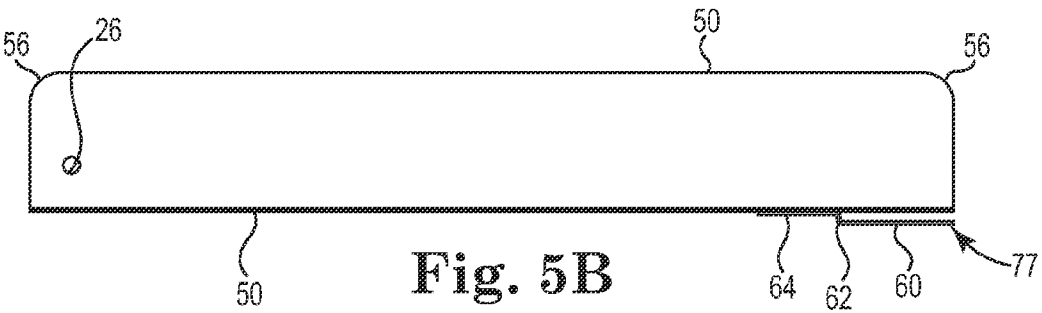

FIGS. 5A and 5B illustrate side views of shelf extension 12 according to one embodiment. In one embodiment, each of the two elongated flanges 50 include a connection point 26 and bracket 24, respectively. In one embodiment, brackets 24 include sliding portion 60, stop 62, and fixed portion 64. Fixed portion 64 is fixedly coupled to flange 50. In one embodiment, stop 62 extends away from flange 50 and joins fixed portion 64 to sliding portion 60 in a z-shaped configuration. In one embodiment, connection point 26 is included on elongated flange 50. In one embodiment, connection point 26 is a hole positioned on the opposite end of elongated flange 50 with respect to brackets 24.

Figure 6A:
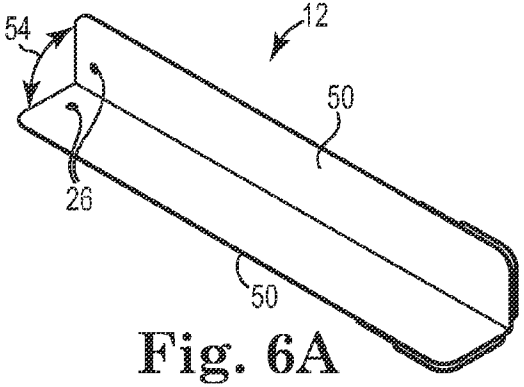
FIGS. 6A and 6B illustrate perspective views of the shelf extension according to one embodiment.
Figure 6B:
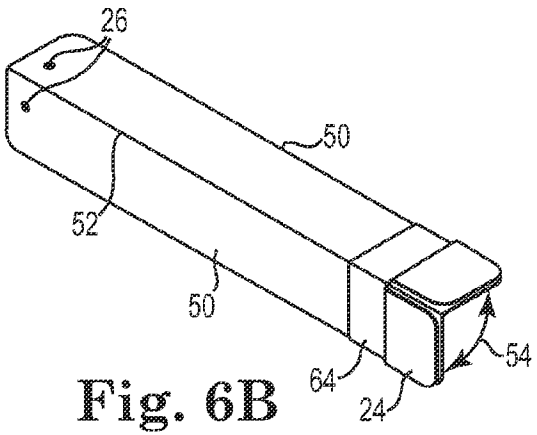
Figure 7:
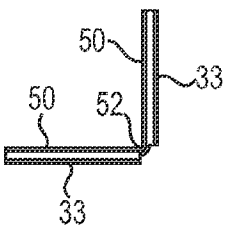
FIG. 7 illustrates an end view of the shelf extension according to one embodiment.

FIGS. 6A and 6B illustrate perspective views of shelf extension 12. Shelf extension 12 includes two elongated flanges 50 that are connected along elongated side 52 at an angle 54 equal to first angle 48 on shelf 10. In one embodiment, the corners 56 of elongated flanges 50 which are not connected along elongated side 52 are rounded or smoothed for safety in handling. FIG. 7 is an end view of shelf extension 12. In one embodiment, the width of brackets 34 extends to be approximately equal to the width of elongated flanges 50.

Figure 8:
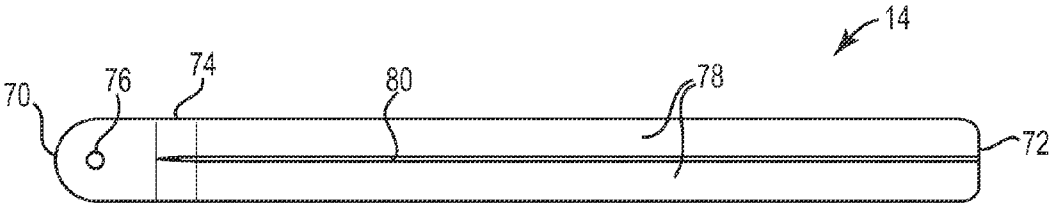
FIG. 8 illustrates a front view of an arm according to one embodiment.
Figure 9:
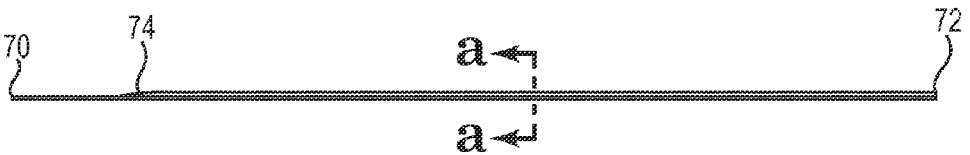
FIG. 9 illustrates a side view of the arm according to one embodiment.
Figure 10:
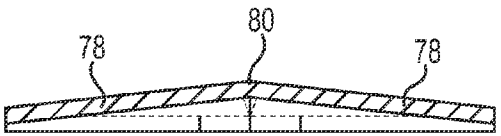
FIG. 10 illustrates a cross-sectional view of the arm according to FIG. 9.

FIGS. 8-10 illustrate embodiments of arm 14. In one embodiment, arm 14 is an elongated plate including first end 70 and opposite second end 72. In one embodiment, first end 70 is flat and includes connection 76. In one embodiment, connection 76 is a hole which corresponds to, and is capable of connecting to at least one of connection point 26 of shelf extension 12. In one embodiment, beveled portion 74 extends from first end 70 and is slightly angled between horizontal planes of the first end 70 and second end 72. In one embodiment, extending from beveled portion 74, toward second end 72, sides 78 are bent slightly inward along center line or ridge 80.

Figure 11:
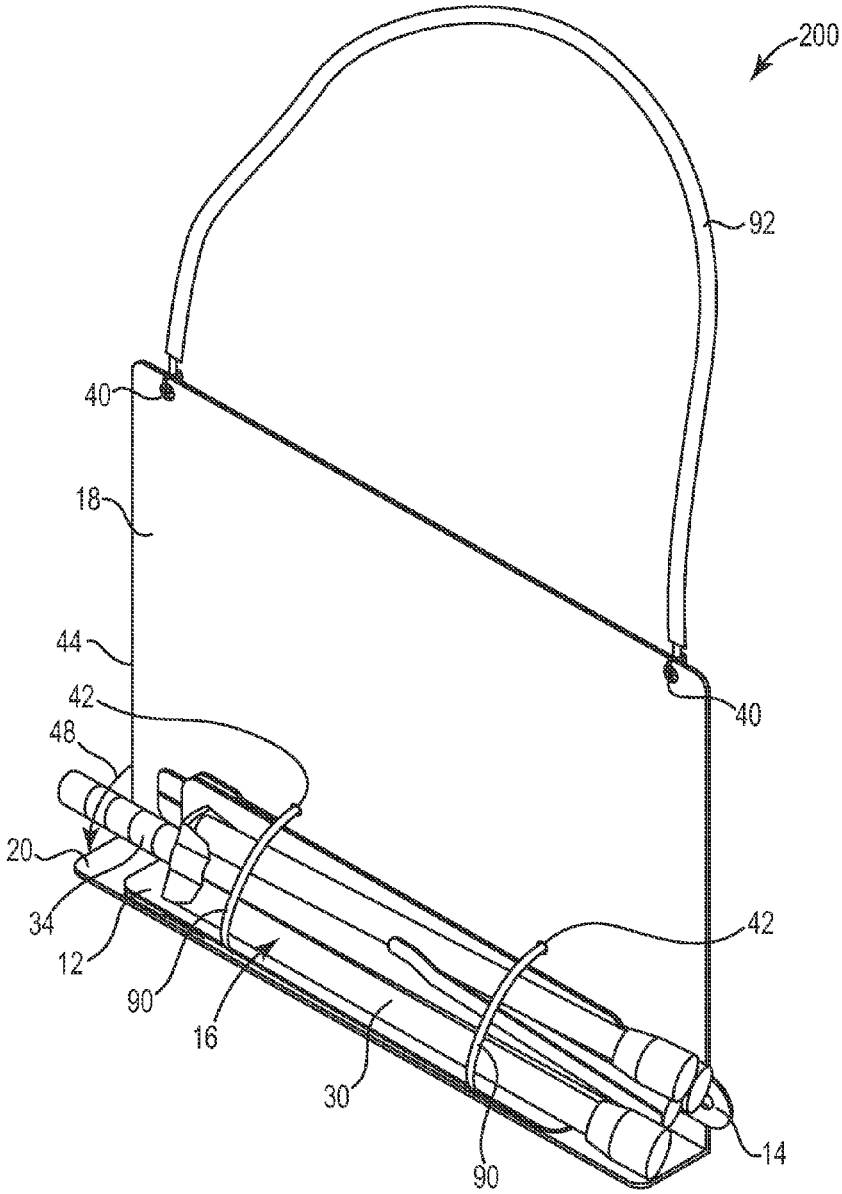
FIG. 11 illustrates a perspective view of the portable stand as assembled for carrying according to one embodiment.

FIG. 11 illustrates portable stand 200 configured for transport or storage according to one embodiment. In one embodiment, portable stand 200 includes shoulder strap 92 and flexible connectors 90. As discussed above, holes 40 are included in back plate 18 for attachment of a carrying strap as well as holes 42 for attachment of flexible connectors 90 which secure the shelf extension 12, arm 14, tripod 16 or other elements to the shelf 12 during transport or storage. In one embodiment, the portable stand 200 may be easily transported with or without the additional use of a carrying bag.

In one embodiment, flexible connectors 90 secure tripod 16 to back plate 18 by connecting to holes 42. In another embodiment, flexible connectors 90 are removably secured with one end at holes 42 and an opposing end removably secured at side edge 22. In one embodiment, flexible connectors 90 are extendable straps of elastic material with hooks at both ends, although other suitable attachment devices may be used. In one embodiment, holes 42 are positioned such that when tripod 16 is secured to back plate 18, tripod 16 is positioned on top of bottom plate 20. In one embodiment, tripod 16 is a collapsible stand and is secured to back plate 12 in its collapsed state. In one embodiment, legs 30 are collapsed or retracted parallel to telescoping rod 34. In another embodiment, additional items may be secured by flexible connectors 90 to back plate 18. In one embodiment, tripod 16 in a collapsed state, shelf extension 12 and arm 14 are each approximately the length of bottom edge 17.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A portable stand comprising:

a shelf comprising:

a back plate having a front surface and a rear surface, wherein the back plate includes at least two attachment locations and at least one securing locations;

a bottom flange forming an angle with the back plate, extending toward the front surface at a first angle from the plate; and a mounting element;

a shelf extension including two elongated flanges formed at an angle equal to the first angle configured to selectively couple to the shelf; and an arm pivotably attachable to the shelf extension.

2. The portable stand of claim 1, further comprising a collapsible stand including an engagement portion at a first end, at least one support leg at a second end, and a vertical post extending between the first end and the second end, wherein the vertical post comprises segments configured to provide an adjustable vertical post length.

3. The portable stand of claim 1, wherein the shelf extension is configured for slideable engagement with the shelf.

4. The portable stand of claim 3, wherein the shelf extension further comprises a bracket coupled to at least one of the two elongated flanges.

5. The portable stand of claim 1, wherein the shelf extension is cantilevered from the shelf.

6. The portable stand of claim 1, wherein the shelf, the shelf extension and the arm are comprised of a rigid material.

7. The portable stand of claim 1, wherein the shelf, the shelf extension and the arm are comprised of a powder-coated metal.

8. The portable stand of claim 1, wherein the first angle is 90°.

9. The portable stand of claim 2, further comprising at least one flexible connector extendable from the at least one securing locations configured to releasably secure the extension, the arm and the collapsible stand to the shelf.

10. The portable stand of claim 1, further comprising a shoulder strap configured to selectively couple to the shelf at the at least two attachment locations.

11. A portable stand comprising:

a work platform comprising:

a rigid plate having a front surface, a rear surface, an upper edge, a lower edge, two side edges, and at least two holes extending from the front surface to the rear surface;

a flange protruding from the bottom edge of the rigid plate approximately perpendicular to the front surface; and a mounting device;

an extender configured for removable attachment to the work platform, the extender comprising:

an elongated, angled body including a first leg and a second leg wherein the first leg is approximately perpendicular to the second leg;

at least one bracket configured to provide a cantilevered attachment of the extender to one of the two side edges of the rigid plate and the flange; and a support arm having a proximal end and a distal end, wherein the proximal end is flat;

a collapsible tripod stand; and at least one flexible connector.

12. The portable stand of claim 11, further comprising a carrying strap.

13. The portable stand of claim 11, wherein the at least two attachment holes are positioned and sized to accommodate the at least one flexible connector.

14. The portable stand of claim 12, wherein the at least two attachment holes are positioned and sized to accommodate the carrying strap.

15. The portable stand of claim 11, wherein the flange and the first leg extend the same distance from the rigid plate when coupled.

16. The portable stand of claim 11, wherein the at least one bracket has a fixed portion fixedly attached proximal to a first end of the first leg, a protruding portion extending toward the first end parallel to the first leg, and a stop between the fixed portion to the protruding portion.

17. The portable stand of claim 11, wherein the at least one flexible connector includes a hook at each opposing end.

18. The portable stand of claim 11, comprising four attachment holes, positioned in two pairs along the lower edge of the back plate, suitable for connection of a pair of the at least one flexible connectors.

19. A portable stand transitionable from a portable state to an erected state, comprising:

a shelf having a top, a bottom and two opposing side edges, the shelf comprising a back plate having a front surface and a rear surface, a flange extending from a bottom edge of the back plate, and a mounting device on the rear surface;

an angled extender comprising a pair of legs adjoined along a longitudinal length bracket connected to each of the pair of legs at a first end of the angled extender, wherein each of the brackets has a bracket width substantially equal to a width of each of the pair of legs, and a connection point at a second end of the angled extender;

an arm;

a collapsible stand having a top end, extendable folding legs at a bottom end, and an extendable post between the top end and the bottom end; and at least one securing strap having a body and two opposing ends;

wherein in the portable state, the collapsible stand is unextended, and wherein the angled extender, arm and collapsible stand are assembled parallel to one another and against the back plate and the flange, and wherein the at least one securing strap is configured to extend over the angled extender, arm and collapsible stand and attach to the shelf with each of the two opposing ends; and wherein in the erected state the mounting device of the shelf is coupled to the top end of the collapsible stand, the folding legs are extended outward from the post, and the post is extended to a desired length, the angled extender is coupled to the side edge and flange of the shelf with the brackets, and the arm is pivotably coupled to the connection point of the angled extender.

20. The portable stand of claim 19, wherein the stand in the portable state is the length of the bottom.

* * * * *